United States Patent [19]

Chess et al.

[11] 4,069,630

[45] Jan. 24, 1978

[54] HEAT REFLECTING WINDOW

[75] Inventors: James S. Chess, Pittsburgh; James A. Davis, Apollo; Robert G. Spindler, Allison Park, all of Pa.

[73] Assignee: PPG Industries, Inc., Pittsburgh, Pa.

[21] Appl. No.: 672,562

[22] Filed: Mar. 31, 1976

[51] Int. Cl.[2] ..... E06B 5/20; H05B 1/00; E04C 2/54

[52] U.S. Cl. ..... 52/172; 52/308; 52/398; 52/616; 428/34; 428/432

[58] Field of Search ..... 52/171, 172, 616, 308, 52/398; 428/34, 432

[56] References Cited

U.S. PATENT DOCUMENTS

| | | | |
|---|---|---|---|
| 2,938,808 | 5/1960 | Duncan et al. | 106/52 |
| 3,296,004 | 1/1967 | Duncan | 106/52 |
| 3,609,293 | 9/1971 | Stewart et al. | 219/200 |
| 3,629,554 | 12/1971 | Stewart | 219/543 |
| 3,710,074 | 1/1973 | Stewart | 219/203 |
| 3,846,152 | 11/1974 | Franz | 52/616 |
| 3,959,565 | 5/1976 | Jordan | 428/432 |

*Primary Examiner*—Alfred C. Perham
*Attorney, Agent, or Firm*—E. Kears Pollock

[57] ABSTRACT

Improved thermal insulation between the inside of a building and the outside environment is provided by a multiple-glazed window comprising two transparent glass sheets, an exterior sheet and an interior sheet, spaced from each other and joined about their edges to form a sealed, enclosed space between them as the exterior sheet is a heat-absorbing glass having an infrared reflecting, transparent film of tin oxide disposed on its surface which faces the interior glass sheet in the window.

8 Claims, 3 Drawing Figures

HEAT REFLECTING WINDOW

BACKGROUND OF THE INVENTION

This invention relates to the art of multiple-glazed windows and more particularly relates to multiple-glazed windows having reflective, transparent coatings of films disposed on a transparent sheet thereof.

Multiple-glazed windows have been used for many years to reduce the loss-or-gain of heat through windows. This object has been achieved by taking advantage of the fact that dry, essentially static gas, usually air, which is maintained in an enclosed space between spaced, generally parallel, sheets (panes or panels) of glass, acts as an effective insulator or thermal barrier. The static, dry air has a relatively low thermal conductivity.

Multiple-glazed windows may be constructed by joining two sheets of glass about their edges or margins in a spaced manner using a marginal spacer between them and a marginal frame around them. The spacer may be a rigid element, such as a metal spacer, or may be a compressible element, such as an organic plastic spacer. The glass sheets may be clear glass, may be colored glass or may be colored, heat-absorbing glass as defined by Federal Specification DD-G-45A (glasses which at a thickness of ¼ inch transmit less than 50 percent of the total incident solar energy). The glass may be laminated, heat-strengthened or tempered. One or more coatings or films may be disposed on one or both sheets of glass. The coatings may be metal, metal oxide or combinations thereof; they may be electroconductive or highly resistive. As described in U.S. Pat. Nos. 3,609,293, 3,629,554 and 3,710,074, all to John L. Stewart, the interior sheet of glass may be provided with an electroconductive tin oxide film as the exterior sheet of glass is a coated or uncoated sheet of colored or heat-absorbing glass. In the last of these patents the patentee discloses and claims the effect of a reflective film on the exterior sheet of glass as an effective iridescence mask for a tin oxide film on the interior sheet of glass.

With the current interest in conserving energy there has developed a great impetus toward making windows which are improved summertime insulators in order to reduce air conditioning loads. It has been an objective to devise windows which are relatively inexpensive as well.

This invention is directed toward such a window.

SUMMARY OF THE INVENTION

A heat-reflecting, multiple-glazed window is proposed. The window comprises two sheets of glass held in substantially parallel spaced relation by a spacer element extending about their facing margins and by a frame extending around their outer margins. The two sheets of glass are an exterior sheet for facing the outside environment and an interior sheet for facing the interior of a building, in a wall of which the window is mounted. The exterior sheet of glass is a colored, heat-absorbing glass and has disposed over its inside face (that which faces the interior sheet) a film of tin oxide having a thickness sufficient to act as a heat-reflecting film. The interior sheet of glass may be a clear glass or a colored, heat-absorbing glass.

The spacer element is preferably a hollow, rigid metal spacer containing a dessicant and having openings to permit communication between the enclosed space between the sheets of glass and the dessicantfilled interior of the spacer. The sheets of glass, the spacer and the frame are joined by an adhesive or mastic which is as moisture- and airimpermeable as practicable in order to insure that the enclosed space of the window is hermetically sealed from the outside environment.

The tin oxide film generally extends over all of the inside face of the exterior sheet of glass although it may be deleted about the margins in the vicinity of the spacer element. The tin oxide film may be made according to the teachings of Lytle et al in U.S. Pat. No. 2,566,346. The tin oxide film may typically have a thickness of from about $2 \times 10^{-7}$ to $3.5 \times 10^{-7}$ meter. The tin oxide film typically has a color that is from first order red to fourth order red as it exhibits color by interference effect. The color of the tin oxide film may be controlled during coating or deposition of the film by adjustment of glass temperature or the rate of reactant delivery by spraying or vapor flow. The tin oxide film may be applied in the manner of coating disclosed and claimed by Donley et al in U.S. Pat. No. 3,660,061 or that disclosed and claimed by Sopko et al in U.S. Pat. No. 3,850,679.

Even though the color of the tin oxide film is an iridescent color, it has been found possible to make a window which has a uniform, generally non-iridescent appearance when the tin oxide film is disposed on a colored, heat-absorbing glass that is the exterior sheet of glass in a multiple-glazed window.

BRIEF DESCRIPTION OF THE DRAWINGS

This invention may be further understood from a study of the accompanying drawings.

DESCRIPTION OF THE PREFERRED EMBODIMENTS

Figure 1:
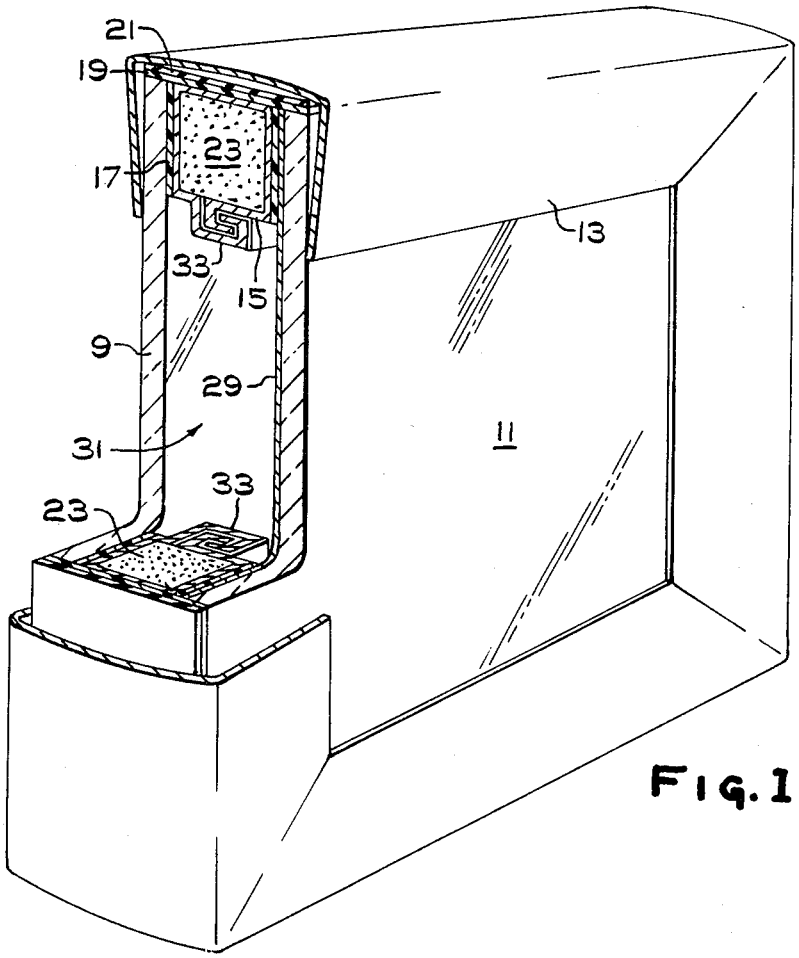
FIG. 1 is a partially cutaway perspective view of a multiple-glazed window according to this invention.

Referring now to FIG. 1, there is shown a preferred embodiment of this invention. An interior glass sheet 9 and an outside glass sheet 11 are disposed in spaced, parallel relation to one another. A metal spacer 15 having a hollow interior filled with a dessicant 23 and having an integral lock seam separates the two sheets of glass, 9 and 11. The seam is provided with openings, apertures or channels 33 through which air and moisture can pass. In combination, the sheets of glass, 9 and 11, and the spacer 15 define an enclosed space 31 between the sheets of glass.

A moisture-resistant mastic 17 bonds the glass sheets, 9 and 11, to the spacer 15, hermetically sealing the enclosed space 31. A moisture barrier 21, such as, for example a plastic sheet, is bonded by moisture-resistant mastic 19 around the periphery of the combination. A channel or frame 13 is disposed around the outer margins of the unit placing a compressive force upon it and giving it stability.

The exterior sheet of glass 11 is a colored, heat-absorbing glass such as a bronze glass or a gray glass. It has a tin oxide film 29 bonded to its inside face which is that surface facing the enclosed space 31 and the other sheet of glass 9. The preferred colored, heat-absorbing glasses are those described and claimed in U.S. Pat. Nos. 2,938,808 and 3,296,004 to Duncan et al for bronze and gray glasses, respectively, and that gray glass described and its manufacture by flotation claimed in U.S. Pat. No. 3,881,905 to Cramer et al. The disclosures of these patents are incorporated by reference herein to describe the preferred glass compositions and their properties.

Figure 2:
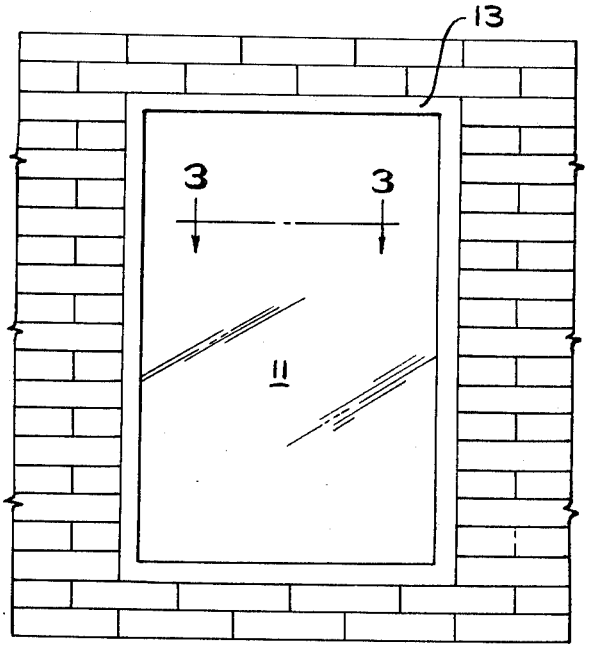
FIG. 2 is an elevation of a building wall in which the multiple-glazed window of this invention is mounted.

As may be observed from FIG. 2, a multiple-glazed window of this invention is mounted in a building wall with its exterior sheet of glass 11 facing the outside environment. Although the tin oxide film itself has an iridescent colored appearance, the window as viewed from outside the building has a uniform appearance.

Figure 3:
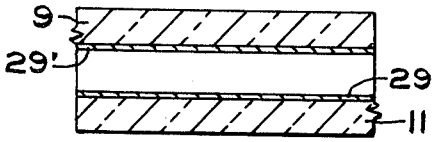
FIG. 3 is a partial sectional view of the multiple-glazed window of FIG. 2 taken along section line 3—3 and showing an optional embodiment of this invention.

As seen from FIG. 3, an optional film of heat-reflecting film 29' may be disposed on the enclosed space surface of the interior sheet of glass 9. Multiple-glazed windows having a tin oxide film on the interior sheet of glass (as film 29') are, of course, known from the abovementioned patents of Stewart which employ a tin oxide film on an interior sheet of glass as an electroconductive heating film. It would be possible to add electrical connectors and bus bars to film 29' and use it in the manner of Stewart during cold weather. Meanwhile, for summer conditions the film 29' would serve as a heat-reflecting film, though less effectively than film 29 on the inside face of the exterior sheet of glass 11.

The interior sheet of glass 9 is preferably clear glass in order to minimize the reduction of visible light transmitted through the window to the interior of a building. Nevertheless, the interior sheet of glass may also be a colored, heat-absorbing glass if desired.

The preferred embodiments of this invention have the belowdescribed performance characteristics, and it may be noted that the described multiple-glazed windows are quite effective in rejecting undesired solar energy while permitting the transmission of desired visible light that is muted, but uniform, due to the combined effect of the exterior colored, heat-absorbing glass, its bonded, heat-reflecting coating and its associated high-transmissive interior glass.

A preferred multiple-glazed window has an exterior sheet of bronze glass with a tin oxide film on it and an interior sheet of uncoated, clear glass separated by a metal spacer to a spacing of from about $\frac{1}{8}$ inch to about 2 inches (3 to 50 millimeters).

The bronze glass, at a thickness of $\frac{1}{4}$ inch (6.3 millimeters) and uncoated, has a visible light or luminous transmittance of from 47 to 57 percent, a transmittance dominant wavelength of from 575 to 585 nanometers (millimicrons) and a transmittance excitation purity of from 6 to 12 percent. Coated with tin oxide, it has a luminous reflectance from its uncoated side of from 5 to 10 percent, a reflective dominant wavelength of from 570 to 580 nanometers and a reflective excitation purity of from 2 to 20 percent while its transmittance properties are from 40 to 50 percent luminous transmittance, 575 to 590 transmittance dominant wavelength and from 2 to 15 percent transmittance excitation purity. The interior sheet of glass is preferably a clear sheet of glass having a luminous transmittance of from 80 to 98 percent.

This preferred multiple-glazed window has a luminous transmittance of from 35 to 45 percent, a transmittance dominant wavelength of from 573 to 583 nanometers, a transmittance excitation purity of from 3 to 15 percent, a shading coefficient of from 0.4 to 0.5 and an overall summer heat transfer coefficient or U-value of from 0.45 to 0.55. The window, with light incident on its exterior sheet of glass, has an exterior luminous reflectance of from 5 to 15 percent, an exterior reflective dominant wavelength of from 570 to 580 nanometers and an exterior reflective excitation purity of from 5 to 20 percent.

The color characteristics are defined according to the international color convention as described in Hardy A.C., The Handbook of Colorimetry, MIT Press, Cambridge, Massachusetts (1936) and are measured using a Beckman Instruments DK-2A Spectrophotometer with a standard white magnesium oxide block used as a perfect reflector and air as a perfect transmission medium. The shading coefficient is defined as the ratio of solar heat gain through a multiple-glazed window to that through a single sheet of double strength, clear sheet glass of equal area. The spectral range of total solar energy is defined as being between 300 and 2100 nanometers ($10^{-9}$ meters) while the visible light range is defined as being between 380 and 76 nanometers; below that is the ultraviolet range and above that is the infrared (or heat) range. The overall heat transfer coefficients (U-values are expressed as BTU/hour-square foot (3.152 watt/square meter).

A second preferred multiple-glazed window has an exterior sheet of gray glass with a tin oxide film on it and an interior sheet of uncoated, clear glass separated by a metal spacer to a spacing of from about $\frac{1}{8}$ inch to about 2 inches (3 to 50 millimeters).

The gray glass, at a thickness of $\frac{1}{4}$ inch (6.3 millimeters) and uncoated, has a visible light or luminous transmittance of from 35 to 45 percent, a transmittance dominant wavelength of from 470 to 480 nanometers and a transmittance excitation purity of from 2 to 8 percent. Coated with tin oxide, it has a luminous reflectance from its uncoated side of from 5 to 10 percent, a reflective dominant wavelength of from 470 to 520*c* nanometers and a reflective excitation purity of from 5 to 25 percent while its transmittance properties are from 42 to 52 percent luminous transmittance, 525 to 502*c* nanometers transmittance dominant wavelength and 0.5 to 5 percent transmittance excitation purity. The interior sheet of glass is like that employed with the exterior bronze glass already described.

The preferred multiple-glazed window has a luminous transmittance of from 37 to 47 percent, a transmittance dominant wavelength of from 500 to 550*c* nanometers, a transmittance excitation purity of from 0.2 to 5 percent, a shading coefficient of from 0.5 to 0.6 and an overall summer heat transfer coefficient or U-value of from 0.45 to 0.65. The window, with light incident on its exterior sheet of glass, has an exterior luminous reflectance of from 6 to 12 percent, an exterior reflective dominant wavelength of from 475 to 525*c* nanometers and an exterior reflective excitation purity of from 2 to 20 percent.

The following examples summarize the properties of both bronze and gray glasses having tin oxide films disposed on them as well as the properties of multiple-glazed windows employing such coated sheets of heat-absorbing glass as exterior sheets with the films disposed inwardly in the windows.

EXAMPLE 1

A multiple-glazed window has an exterior sheet of bronze glass with a tin oxide film on it and an interior sheet of uncoated, clear glass separated by a metal spacer to a spacing of $\frac{1}{2}$ inch (13 millimeters).

The bronze glass is ¼ inch (6.3 millimeters) thick and is coated with a tin oxide film having a surface resistance of 32 ohms per square. It has a visible light or luminous transmittance of 42.3 percent, a transmittance dominant wavelength of 577.28 nanometers and a transmittance excitation purity of 13.43 percent. It has a luminous reflectance from its uncoated side of 7.1 percent, a reflective dominant wavelength of 571.48 nanometers and a reflective excitation purity of 3.27 percent. With light incident on the film, it has a luminous reflectance of 11.3 percent, a reflective dominant wavelength of 451.43 nanometers and a reflective excitation purity of 4.33 percent.

The multiple-glazed window has a luminous transmittance of 37.5 percent, a transmittance dominant wavelength of 574.29 nanometers and a transmittance excitation purity of 12.57 percent. It has an exterior luminous reflectance of 8.5 percent, a reflective dominant wavelength of 576.40 nanometers and a reflective excitation purity of 6.71 percent. It has a shading coefficient of 0.42, an overall summer heat transfer coefficient or U-valve of 0.49 and an overall winter heat transfer coefficeint of U-value of 0.43.

EXAMPLE II

A multiple-glazed window has an exterior sheet of bronze glass with a tin oxide film on it and an interior sheet of uncoated, clear glass separated by a metal spacer to a spacing of ½ inch (13 millimeters).

The bronze glass is ¼ inch (6.3 millimeters) thick and is coated with a tin oxide film having a surface resistance of 60 ohms per square. It has a visible light or luminous transmittance of 45 percent, a transmittance dominant wavelength of 585.76 nanometers and a transmittance excitation purity of 5.1 percent. It has a luminous reflectance from its uncoated side of 8.5 percent, a reflective dominant wavelength of 571.04 nanometers and a reflective excitation purity of 19.07 percent. With light incident on the film, it has a luminous reflectance of 15.1 percent, a reflective dominant wavelength of 569.71 nanometers and a reflective excitation purity of 36.75 percent.

The multiple-glazed window has a luminous transmittance of 40 percent, a transmittance dominant wavelength of 579.26 nanometers and a transmittance excitation purity of 4.42 percent. It has an exterior luminous reflectance of 10.1 percent, a reflective dominant wavelength of 571.86 nanometers and a reflective excitation purity of 17.15 percent. It has a shading coefficient of 0.48, an overall summer heat transfer or U-value of 0.51 and an overall winter heat transfer coefficient or U-value of 0.45.

EXAMPLE III

A multiple-glazed window has an exterior sheet of gray glass with a tin oxide film on it and an interior sheet of uncoated, clear glass separated by a metal spacer to a spacing of ½ inch (13 millimeters).

The gray glass is 3/16 inch (4.7 millimeters) thick and is coated with a tin oxide film having a surface resistance of 43 ohms per square. It has a visible light or luminous transmittance of 44.2, a transmittance dominant wavelength of 502.41*c* nanometers and a transmittance excitation purity of 1.71 percent. It has a luminous reflectance from its uncoated side of 7.5 percent, a reflective dominant wavelength of 487.41 nanometers and a reflective excitation purity of 11.67 percent. With light incident on the film, it has a luminous reflectance of 12.4 percent, a reflective dominant wavelength of 488.61 nanometers and a reflectance excitation purity of 21.36 percent.

The multiple-glazed window has a luminous transmittance of 39.5 percent, a transmittance dominant wavelength of 548.02*c* nanometers and a transmittance excitation purity of 0.36 percent. It has an exterior luminous reflectance of 9 percent, a reflective dominant wavelength of 486.49 nanometers and a reflective excitation purity of 9.74 percent. It has a shading coefficient of 0.53, an overall summer heat transfer coefficient or U-value of 0.49 and an overall winter heat transfer coefficient or U-value of 0.43.

EXAMPLE IV

A multiple-glazed window has an exterior sheet of gray glass with a tin oxide film on it and an interior sheet of uncoated, clear glass separated by a metal spacer to a spacing of ½ inch (13 millimeters).

The gray glass is 3/16 inch (4.7 millimeters) thick and is coated with a tin oxide film having a surface resistance of 60 ohms per square. It has a visible light or luminous transmittance of 47.3 percent, a transmittance dominant wavelength of 573.58 nanometers and a transmittance excitation purity of 4.29 percent. It has a luminous reflectance from its uncoated side of 6.5 percent, a reflective dominant wavelength of 474.81 nanometers and a reflective excitation purity of 20.08 percent. With light incident on the film, it has a luminous reflectance of 8.3 percent, a reflective dominant wavelength of 477.59 nanometers and a reflective excitation purity of 41.63 percent.

The multiple-glazed window has a luminous transmittance of 42.1 percent, a transmittance dominant wavelength of 562.95 nanometers and a transmittance excitation purity of 3.51 percent. It has an exterior luminous reflectance of 8.3 percent, a reflective dominant wavelength of 476.39 nanometers and a reflective excitation purity of 15.56 percent. It has a shading coefficient of 0.54, an overall summer heat transfer coefficient or U-value of 0.51 and an overall winter heat transfer coefficient or U-value of 0.45.

EXAMPLE V

A multiple-glazed window has an exterior sheet of gray glass with a tin oxide film on it and an interior sheet of uncoated, clear glass separated by a metal spacer to a spacing of ½ inch (13 millimeters).

The gray glass is ⅛ inch (3.1 millimeters) thick and is coated with a tin oxide film having a surface resistance of 20 ohms per square. It has a visible light or luminous transmittance of 50.7 percent, a transmittance dominant wavelength of 527.82 nanometers and a transmittance excitation purity of 0.82 percent. It has a luminous reflectance from its uncoated side of 8.3 percent, a reflective dominant wavelength of 523.64*c* nanometers and a reflective excitation purity of 6.72 percent. With light incident on the film, it has a luminous reflectance of 12.7 percent, a reflective dominant wavelength of 505.55*c* nanometers and a reflective excitation purity of 9.58 percent.

The multiple-glazed window has a luminous transmittance of 44.8 percent, a transmittance dominant wavelength of 505.29 nanometers and a transmittance excitation purity of 1.48 percent. It has an exterior luminous reflectance of 10.3 percent, a reflective dominant wavelength of 522.74*c* nanometers and a reflective excitation purity of 4.15 percent. It has a shading coefficient of 0.55, an overall summer heat transfer coefficient or U-value of 0.45 and an overall winter heat transfer coefficient or U-value of 0.40.

While this invention has been described with reference to particularly preferred embodiments thereof, those skilled in the art will recognize that expedient modifications may be made without departing from the spirit of the invention as here taught and claimed. The glass sheets may be any convenient thickness.

We claim:

1. A multiple-glazed window mounted in a building wall comprising a pair of glass sheets, an exterior sheet of colored, heat-absorbing glass facing the outside environment and an interior sheet, disposed in substantially parallel, spaced relation to each other, a heat reflective, transparent tin oxide-containing coating disposed over substantially all of the inside face of the exterior sheet of glass which faces the interior sheet of glass, a spacer disposed about the inside marginal edges of the pair of sheets to maintain them in spaced relation with a dessicant disposed in the spacer, and a frame about the outside marginal edges of the pair of sheets wherein the margins of the sheets and the spacer are bonded together forming a hermetically sealed space between the sheets of glass.

2. The multiple-glazed window according to claim 1 wherein the exterior sheet of glass is a bronze colored, heat-absorbing glass and the tin oxide film has a thickness sufficient to provide the window with a shading coefficient of from 0.4 to 0.5.

3. The multiple-glazed window according to claim 2 wherein the interior sheet of glass is clear glass.

4. The multiple-glazed window according to claim 1 wherein the exterior sheet of glass is a gray colored, heat-absorbing glass and the tin oxide film has a thickness sufficient to provide the window with a shading coefficient of from 0.5 to 0.6.

5. The multiple-glazed window according to claim 4 wherein the interior sheet of glass is clear glass.

6. The multiple-glazed window according to claim 1 wherein the exterior sheet of glass is a bronze colored, heat-absorbing glass and the tin oxide film has a thickness sufficient to provide the window with a luminous transmittance of from 35 to 45 percent, a transmittance dominant wavelength of from 573 to 583 nanometers, a transmittance excitation purity of from 3 to 15%, an exterior luminous reflectance of from 5 to 15 percent, an exterior reflective dominant wavelength of from 570 to 580 nanometers and an exterior reflective excitation purity of from 5 to 20 percent.

7. The multiple-glazed window according to claim 1 wherein the exterior sheet of glass is a gray colored, heat-absorbing glass and the tin oxide film has a thickness sufficient to provide the window with a luminous transmittance of from 37 to 47 percent, a transmittance dominant wavelength of from 500 to 550*c* nanometers, a transmittance excitation purity of from 0.2 to 5 percent, an exterior luminous reflectance of from 6 to 12 percent, an exterior reflective dominant wavelength of from 475 to 525*c* nanometers and an exterior reflective excitation purity of from 2 to 20 percent.

8. The multiple-glazed window according to claim 1 wherein the tin oxide film has a thickness sufficient to provide the window with a summer U-value of from 0.40 to 0.52.

* * * * *